US011600961B2

(12) United States Patent
Wang et al.

(10) Patent No.: US 11,600,961 B2
(45) Date of Patent: Mar. 7, 2023

(54) ADAPTOR

(71) Applicant: Xuetao Wang, Shenzhen (CN)

(72) Inventors: Xuetao Wang, Shenzhen (CN); Peiling Zhang, Shenzhen (CN); Zhuzhan Liu, Shenzhen (CN); Feng Lin, Shenzhen (CN)

(73) Assignee: Xuetao Wang, Shenzhen (CN)

( * ) Notice: Subject to any disclaimer, the term of this patent is extended or adjusted under 35 U.S.C. 154(b) by 0 days.

(21) Appl. No.: 17/343,412

(22) Filed: Jun. 9, 2021

(65) Prior Publication Data

US 2022/0209478 A1 Jun. 30, 2022

(30) Foreign Application Priority Data

Dec. 29, 2020 (CN) ..... 202023251307.9

(51) Int. Cl.
*H01H 13/02* (2006.01)
*H01R 31/06* (2006.01)
*H01R 13/66* (2006.01)

(52) U.S. Cl.
CPC ..... *H01R 31/065* (2013.01); *H01R 13/6691* (2013.01)

(58) Field of Classification Search
CPC .... H01H 1/403; H01H 1/5805; H01H 19/585; H01H 13/70; H01H 13/705; H01H 13/6616; H01H 31/06
See application file for complete search history.

(56) References Cited

U.S. PATENT DOCUMENTS

2010/0123006 A1* 5/2010 Chen ..... G06K 7/0021 235/441
2014/0302705 A1* 10/2014 Park ..... H04M 1/236 439/660

* cited by examiner

*Primary Examiner* — Phuong Chi Thi Nguyen
(74) *Attorney, Agent, or Firm* — Steven M. Koehler; Westman, Champlin & Koehler, P.A.

(57) ABSTRACT

The present application provides an adaptor, the adaptor includes a plug, a signal extension cord and an adaptor body; the signal extension cord is in an L shape, and one end of the signal extension cord is connected to a sidewall of a tail end of the plug, the other end of the signal extension cord is connected to the adaptor body, such that the plug, the signal extension cord and the adaptor body are integrally formed a U-shaped structure, and when the adaptor is configured to be plugged into a communication interface of an electronic device, the adaptor body is configured to be located on a back side of the electronic device. The present application provides an adaptor, which has a function of curved structure, and improves the user experience when holding the electronic device.

13 Claims, 7 Drawing Sheets

ADAPTOR

CROSS-REFERENCE TO THE RELATED APPLICATION

The present application claims the priority of Chinese Application 202023251307.9, filed on Dec. 29, 2020, the content of which is incorporated herein by reference.

TECHNICAL FIELD

The present application relates to the technical field of wireless communication transmission, and more particularly to a curved adaptor.

BACKGROUND

With the development of technology, various wireless transmission technologies have emerged, and wireless connections can be established for communication between electronic devices.

Currently, there are many types of adaptors on the market that are used to establish wireless communication between two electronic devices such as mobile phones and headsets. The user can plug the adaptor into the mobile phone and receive the audio signal through the wireless headset, without being restricted by the wired headset wire when playing games and watching videos.

As shown in FIG. 1, the plug and the adaptor body of the existing adaptor are directly connected and integrated, and the adaptor body is fixed at the tail end of the plug. The plug and the adaptor body extend in a horizontal direction, such that the overall length of the adaptor is longer. When this kind of adaptor is plugged into a mobile phone, due to the long overall length of the adaptor, the adaptor will protrude a lot from the interface of the mobile phone. When the user is holding the phone horizontally, the adaptor will disturb the hand of the user, which reduces the holding feel of the user.

SUMMARY

The present application provides an adaptor, the structure is simple, and having a curved structure, which improves the user experience when holding the electronic device.

The present application provides an adaptor. The adaptor includes a plug, a signal extension cord and an adaptor body; the signal extension cord is in an L shape, and one end of the signal extension cord is connected to a sidewall of a tail end of the plug, the other end of the signal extension cord is connected to the adaptor body, such that the plug, the signal extension cord and the adaptor body are integrally formed a U-shaped structure, and when the adaptor is configured to be plugged into a communication interface of an electronic device, the adaptor body is configured to be located on a back side of the electronic device.

According to the adaptor provided by the present application, the plug and the adaptor body are kept electrically connected through the signal extension cord. The signal extension cord has an L-shaped curved structure, and one end of the signal extension cord is connected to tail end of the sidewall of the plug, and the other end of the signal extension cord is connected to the adaptor body. The adaptor body is guided in the direction of the plug, so that the entire adaptor has a "U"-shaped structure as a whole. The adaptor body in the prior art is extended in the horizontal direction of the plug, and the plug and the adaptor body are located on the same horizontal plane, resulting in a longer length of the entire adaptor; the adaptor body of the present application is connected to the sidewall of the tail end of the plug through the signal extension cord with an L-shaped bending structure. The signal extension cord is extended in the vertical direction of the plug, which shortens the length of the adaptor in the horizontal insertion direction of the plug. When the plug is plugged into the communication interface of the electronic device, the bottom cover of the plug abuts against the outer edge of the communication interface of the electronic device, and the L-shaped curved structure of the signal extension cord guides and fits the adaptor body to the back side of the electronic device, such that the entire adaptor will not protrude too much from the electronic device. The adaptor provided by the present application has a simple structure and easy implementation, it only adds the L-shaped curved signal extension cord structure, which not only realizes the electrical connection between the adaptor body and the electronic device, and enables the electronic device to wirelessly connect with other devices such as wireless headset through the adaptor, to bring a better listening experience to the user, but also the adaptor will not protrude too much from the electronic device, and it will not disturb the hand of the user when in used, which improves the user's hand feeling and experience when holding the electronic device.

In a possible implementation, the L-shaped structure of the signal extension cord is a fixed curved structure.

Herein, the shape of the signal extension cord will not change, and the L-shaped structure can adapt to the thickness of most electronic devices on the market, and the structure is stable, which can ensure the stability of the electrical connection between the plug and the adaptor body.

In a possible implementation, the L-shaped structure of the signal extension cord is an adjustable curved structure.

Herein, the user can straighten the signal extension cord and then bend it, that is, the user can adjust the L-shaped curved structure according to different electronic devices, so that the adaptor can adapt to electronic devices of different thicknesses.

In a possible implementation, the signal extension cord includes: a flexible flat cable and a metal support sheet arranged side by side, and a soft rubber sleeve covering at an outside of the flexible flat cable and the metal support sheet.

The metal support sheet has a certain degree of hardness and strength, and it is arranged side by side with the flexible flat cable to support and protect the flexible flat cable. The soft rubber sleeve plays a good role in protecting the flexible flat cable and the metal support sheet In a possible implementation, the adaptor body has a flat structure and is configured for closely attaching to the back side of the electronic device.

In a possible implementation, the adaptor body includes: a housing and a circuit board and a communication module, the circuit board and the communication module are fixedly disposed inside the housing, and the communication module is fixedly arranged on the circuit board, the signal extension cord is electrically connected to the circuit board.

The housing plays a role of fixing and protecting the circuit board therein. The communication module is integrated on the circuit board to realize audio signal processing and wireless transmitting and receiving functions.

In a possible design, the adaptor body further includes: a charging interface electrically connected to the circuit board, and the charging interface is configured for charging the electronic device.

When the adaptor is plugged into the electronic device, a charging interface of the electronic device is occupied, and the electronic device cannot be charged. The adaptor body is provided with the charging interface, such that even if the electronic device is connected to the adaptor, it can be charged at the same time without affecting the use of the user. When the power of the electronic device is low, it can be connected to the wireless headset through the adaptor and connected to an external power source, simultaneously.

The user does not have to worry about the power issue of the electronic device while enjoying the good sense of hearing brought by the low-latency audio.

Optionally, the plug is a Type-C USB plug, a micro USB plug or a lightning plug.

Different plugs are suitable for different types of electronic devices. For example, if the adaptor is connected to an electronic device equipped with an Android system, the plug is a Type-C or micro-USB type plug, and if it is connected to an electronic device equipped with an IOS operating system, the plug is a lightning type.

The adaptor provided in the present application covers most of the electronic devices on the market by changing the plug type to connect to different electronic devices. The user can choose the corresponding adaptor according to the interface type of electronic device they use, which can meet the needs of the user.

In a possible implementation, the adaptor is configured to communicate with a wireless headset.

Specifically, a communication connection with the wireless headset is established through the communication module in the adaptor body, and the adaptor sends the audio signal to the wireless headset so that the user can listen to the audio played by the electronic device through the wireless headset.

In a possible implementation, the electronic device is a mobile phone or a tablet computer.

As long as the plug of the adaptor matches the communication interface of the electronic device, it can be connected with the electronic device, thereby realizing the wireless connection between the electronic device and the wireless headset or other devices.

Figure 1:
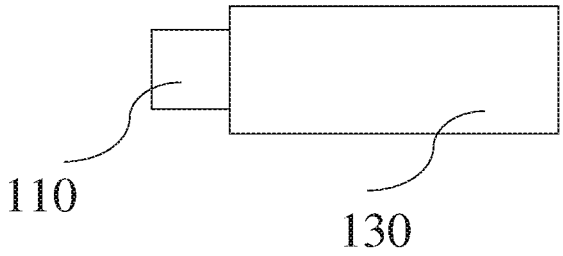
FIG. 1 is a structural schematic view of an adaptor in the prior art.

100—adaptor;

110—plug; 111—plug rear cover;

120—connection wire; 121—flexible flat cable; 122—iron sheet; 123—soft rubber sleeve;

130—adaptor body; 131—circuit board of adaptor; 132—housing; 133—communication module; 134—charging interface;

200—electronic device.

DETAILED DESCRIPTION

The embodiments of the present application are described in detail below. Examples of the embodiments are shown in the accompanying drawings, in which the same or similar reference numerals indicate the same or similar elements or elements with the same or similar functions. The following embodiments described with reference to the drawings are exemplary, and are only used to explain the present application, and cannot be understood as a limitation to the present application.

In the description of the present application, it should be noted that, unless otherwise clearly specified and limited, the terms "mounting" and "connection" should be understood in a broad sense, for example, it can be a fixed connection, a detachable connection, or an integral connection; it can be a mechanical connection, it can be an electrical connection, or it can communicate with each other; it can be a direct connection or an indirect connection through an intermediary, and it can be a communication between two components or an interaction relationship between two components. For those of ordinary skill in the art, the specific meanings of the above-mentioned terms in the present application can be understood according to specific circumstances.

In the description of the present application, it should be understood that the terms "upper", "lower", "side", "front", "rear", etc. indicate the orientation or positional relationship based on the orientation or positional relationship of the mounting, which is only in order to facilitate the description of the present application and simplify the description, it does not indicate or imply that the device or element referred to must have a specific orientation, be configured and operated in a specific orientation, and therefore cannot be understood as a limitation of the present application.

It should also be noted that in the embodiments of the present application, the same reference numeral is used to denote the same component or the same part. For the same part in the embodiment of the present application, only one of the parts or components may be labeled as an example in the figure. With reference signs, it should be understood that the reference signs are also applicable to other identical parts or components.

FIG. 1 is an adaptor structure in the prior art. The plug and the adaptor body are directly connected and integrated. The adaptor body is fixed at a tail end of the plug. The adaptor body extends in a horizontal direction of the plug, such that the overall length of the adaptor is longer. When such an adaptor is plugged into a charging interface of an electronic device such as a mobile phone or a tablet computer, the entire adaptor will protrude from the phone a lot. When the user is holding the electronic device, the adaptor will disturb the hand of the user, which makes the holding experience of the user worse.

In response to the above-mentioned problems, the present application provides an adaptor. The adaptor presents a U-shaped structure as a whole. When plugged into an electronic device, it does not protrude too much, which improves the handing feel of the user when grips the electronic device.

Figure 2:
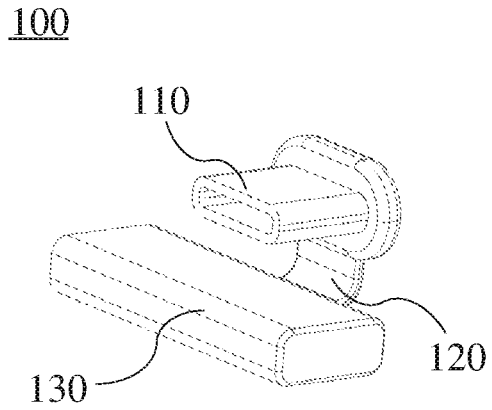
FIG. 2 is a structural schematic view of an adaptor provided by an embodiment of the present application.

FIG. 2 is a schematic view of the overall structure of the adaptor 100 provided by an embodiment of the present application. As shown in FIG. 2, the present application provides an adaptor 100, which includes a plug 110, a signal extension cord 120, and an adaptor body 130.

Among them, the signal extension cord 120 is in an L shape, one end of which is connected to the side wall of the tail end of the plug 110, and the other end of which is connected to the adaptor body 130. Under the connection of the L-shaped signal extension cord 120, the plug 110, the signal extension cord 120 and the adaptor body 130 are formed a U-shaped structure as a whole. When the adaptor 100 is plugged into the communication interface of the electronic device 200, the adaptor body 130 is located on the back side of the electronic device 200.

According to the adaptor 100 provided by the present application, the plug 110 and the adaptor body 120 are kept electrically connected through the signal extension cord 120, the signal extension cord 120 has an L-shaped curved structure, and one end of the signal extension cord 120 is connected to tail end of the sidewall of the plug 110, and the other end of the signal extension cord 120 is connected to the adaptor body 130. The adaptor body 130 is guided in the direction of the plug 110, so that the entire adaptor 100 has a U-shaped structure as a whole. The adaptor body 130 in the prior art is extended in the horizontal direction of the plug 110, and the plug 110 and the adaptor body 130 are located on the same horizontal plane, resulting in a longer length of the entire adaptor 100; the adaptor body 130 of the present application is connected to the sidewall of the tail end of the plug 110 through the signal extension cord 120 with an L-shaped bending structure. The signal extension cord 120 is extended in the vertical direction of the plug 110, which shortens the length of the adaptor 100 in the horizontal insertion direction of the plug 110. When the plug 110 is plugged into the communication interface of the electronic device 200, the bottom cover of the plug 110 abuts against the outer edge of the communication interface of the electronic device 200, and the L-shaped curved structure of the signal extension cord 120 guides and fits the adaptor body 130 to the back side of the electronic device 200, such that the entire adaptor 100 will not protrude too much from the electronic device 200. The adaptor 100 provided by the present application has a simple structure and easy implementation, it only adds the L-shaped curved signal extension cord structure, which not only realizes the electrical connection between the adaptor body 130 and the electronic device 200, and enables the electronic device 200 to wirelessly connect with other devices such as wireless headset through the adaptor, to bring a better listening experience to the user, but also the adaptor 100 will not protrude too much from the electronic device 200, and it will not disturb the hand of the user when in used, which improves the user's hand feeling and experience when holding the electronic device.

Specifically, as shown in FIG. 2, the plug 110 is a plug with 90° right angle, that is, a included angle between the plug 110 and a plug rear cover 111 is 90°, and a included angle with the signal extension cord 120 is also 90°.

When the plug 110 is plugged into the communication interface of the electronic device 200, only a thin plug rear cover 111 abuts the edge of the electronic device 200 providing the communication interface, and the signal extension cord 120 guides the adaptor body 130 to be located on the back side of the electronic device 200.

Optionally, the plug 110 may be a type-C USB plug, a micro USB plug, or a lightning plug.

Different plugs are suitable for different types of electronic devices. For example, if the adaptor 100 is connected to an electronic device 200 equipped with an Android system, the plug 100 is a Type-C or micro-USB type plug, and if it is connected to an electronic device 200 equipped with an IOS operating system, the plug 100 is a lightning type.

The adaptor 100 provided in the present application covers most of the electronic devices on the market by changing the type of the plug 110 to connect to different electronic devices 200. The user can choose the corresponding adaptor 100 according to the interface type of electronic device 200 they use, which can meet the needs of the user.

When plug 110 is a micro-USB type plug, the plug 110 has a front side and back side. The plug 110 can be correctly plugged into the communication interface of electronic device 200 only when the plug 110 is in a right direction. Therefore, the signal extension cord 120 and the adaptor body 130 are arranged on a lower side of the plug 110 when the plug 110 is in the right direction, so as to ensure that when the plug 110 is plugged into the electronic device 200, the adaptor body 130 is located on the back side of the electronic device 200.

Optionally, the L-shaped structure of the signal extension cord 120 is a fixed curved structure.

When the L-shaped structure of the signal extension cord 120 is the fixed curved structure, the shape of the signal extension cord 120 will not change, and the L-shaped structure can adapt to the thickness of most electronic devices on the market, and the structure is stable, which can ensure the stability of the electrical connection between the plug 110 and the adaptor body 130.

Optionally, the L-shaped structure of the signal extension cord 120 is an adjustable bending structure.

When the L-shaped structure of the signal extension cord 120 is the adjustable bending structure, the user can straighten the signal extension cord 120 and then bend it, that is, the user can adjust the L-shaped curved structure according to different electronic devices 200. The adaptor 100 can adapt to electronic devices 200 of different thicknesses. For example, when the user is covered the electronic device 200 with a thicker protective cover, the signal extension cord 120 is straightened first, and then the signal extension cord 120 is started to bend at a position farther away from the plug 110 (that is, the length of the L-shaped structure in a vertical portion is increased), and a new L-shaped curved structure is formed, so that the adaptor 100 can adapt to this thickness; similarly, if the user is using a thinner electronic device 200, the signal extension cord 120 is started to bend at a position closer to the plug 110 (that is, the length of the L-shaped structure in a vertical portion is reduced), so as to avoid a space between the adaptor body 130 and the back side of the electronic device 200 being too much.

Figure 5A:
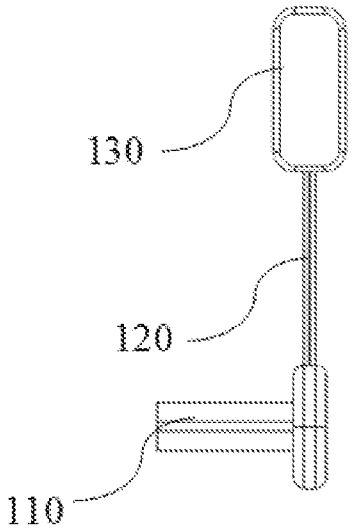
FIG. 5A is a front view of an adaptor before bended provided by an embodiment of the present application.
Figure 5B:
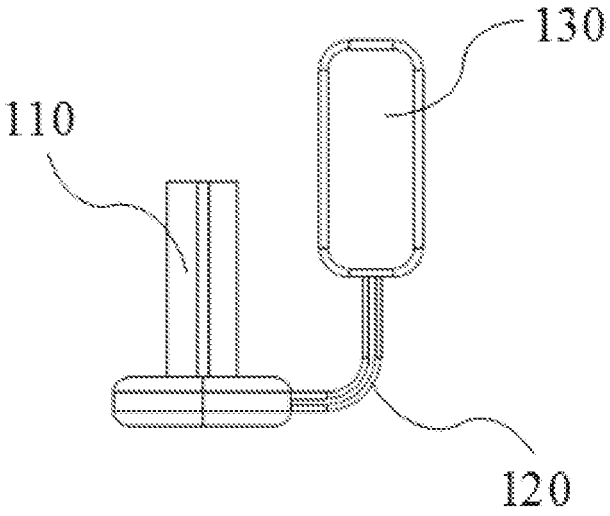
FIG. 5B is a front view of an adaptor after bended provided by an embodiment of the present application.
Figure 6A:
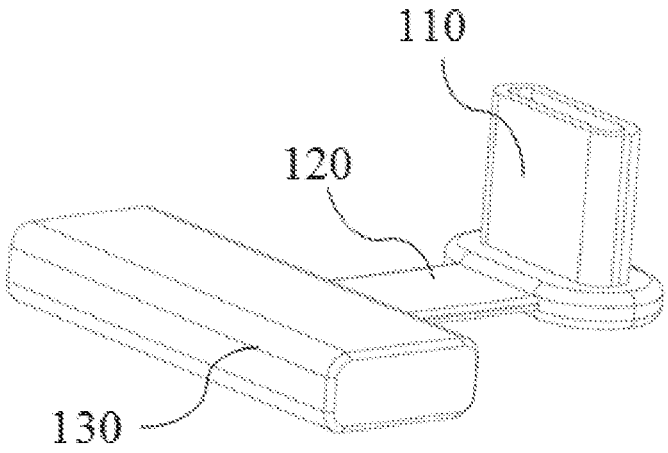
FIG. 6A is a structural schematic view of an adaptor before bended provided by an embodiment of the present application.
Figure 6B:
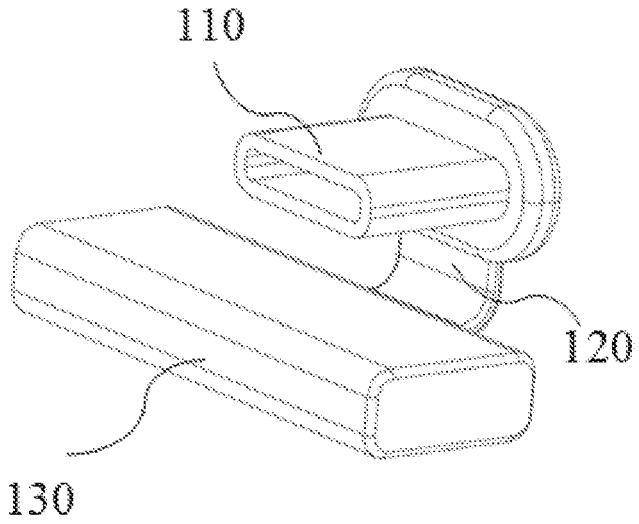
FIG. 6B is a structural schematic view of an adaptor after bended provided by an embodiment of the present application.

As shown in FIGS. 5A to 6 B, FIG. 5A is a schematic view of a state of the adaptor 100 before the signal extension cord 120 is bent, and FIG. 5B is a schematic view of a state of the adaptor 100 after the signal extension cord 120 is bent. In the FIG. 6A, the signal extension cord 120 is in a straightened state, and in the FIG. 6B, the signal extension cord 120 is in a bent state and has an L-shaped structure, and the plug 110, the signal extension cord 120 and the adaptor body 130 are in a U shape as a whole.

Figure 3:
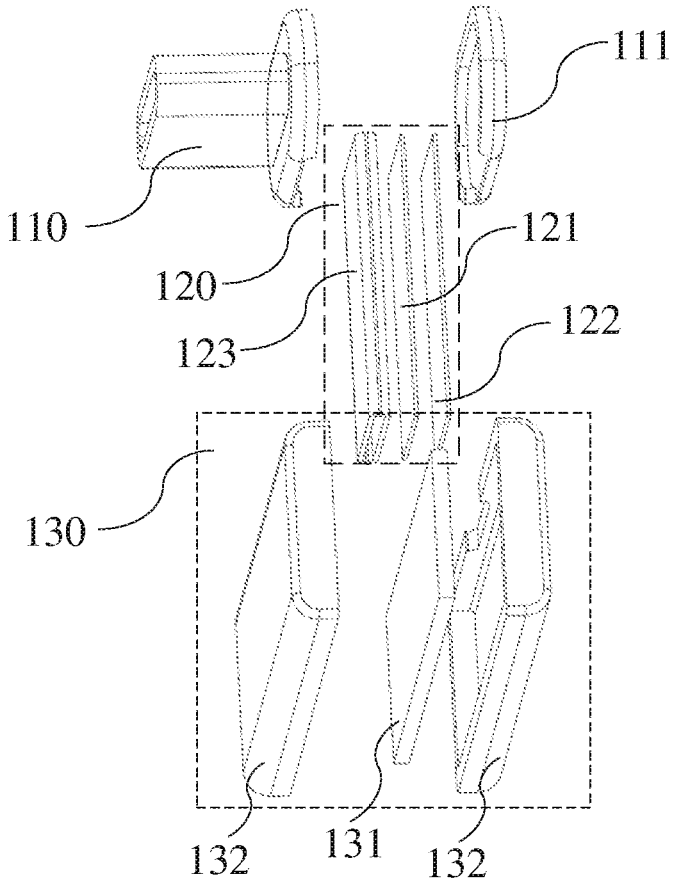
FIG. 3 is an exploded view of an adaptor provided by an embodiment of the present application.

Furthermore, as shown in FIG. 3, the signal extension cord 120 includes: a flexible flat cable 121 and a metal support sheet 122 arranged side by side, and a soft rubber sleeve 123 covering the outside of the flexible flat cable 121 and the metal support sheet 122.

Among them, the number of connected wires and the connection spacing of the flexible flat cable (FFC) 121 can be arbitrarily selected to make the connecting more convenient. Using the flexible flat cable to connect, the volume of electronic products can be reduced, the production costs can be reduced, and the productivity can be increased. In the embodiment of the present application, the flexible flat cable 121 electrically connects the plug 110 and the adaptor body 130 for data transmission, and transmits audio signals from the electronic device 200 to the adaptor body 130.

Here, the metal support sheet 122 has a certain degree of hardness and strength, and being arranged side by side with the flexible flat cable can play a role in supporting, shaping and protecting the flexible flat cable 121. The soft rubber sleeve 123 is the outermost structure of the signal extension cord 120, which covers the inner flexible flat cable 121 and the metal support sheet 122.

Optionally, the soft rubber sleeve can be a silicone sleeve, a rubber sleeve, or the like.

The toughness and softness of the silicone sleeve are well, and it can protect the flexible flat cable 121 and the metal support sheet 122 inside.

Optionally, the metal support sheet 122 has an L-shaped curved structure and is made of a high-hardness metal. Once it is shaped, it will not be deformed again and the structure is stable. At this time, the L-shaped structure of the signal extension cord 120 is a fixed curved structure.

Optionally, the metal support sheet 122 is flexible and bendable, and can be deformed under the action of an external force, which can be bent or straightened after being bended. At this time, the L-shaped structure of the signal extension cord 120 is an adjustable curved structure, and the user can adjust the L-shaped curved structure to adapt the adaptor 100 to electronic devices 200 of different thicknesses.

Optionally, the metal support sheet 122 is an iron sheet, a steel sheet, an aluminum sheet, or a copper sheet.

They have good flexibility and ductility, can be bent into different angles, and can be bent many times without being damaged.

Preferably, the adaptor body 130 has a flat structure and is configured to be closely attached to the back side of the electronic device 200.

Figure 7:
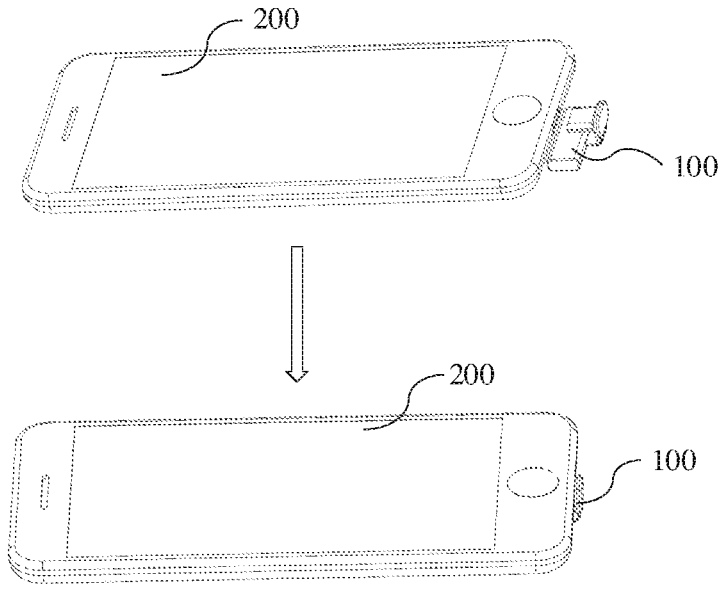
FIG. 7 is a mounted schematic view of an adaptor plugged into an electronic device.
Figure 8:
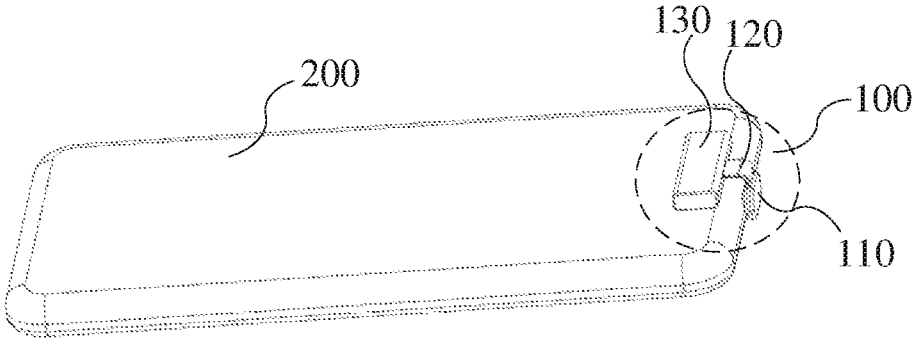
FIG. 8 is a view of a back side of the electronic device after the adaptor is plugged into the electronic device shown in FIG. 7.

As shown in FIGS. 7 and 8, FIG. 7 is a mounted schematic view of the adaptor 100 plugged into the electronic device 200, the plug 110 is plugged into the charging interface of the electronic device 200; FIG. 8 is a view of the back side of the electronic device 200 after the adaptor 100 is plugged into the electronic device 200, the adaptor body 130 is closely attached to the back side of the electronic device 200.

Specifically, as shown in FIG. 3, the adaptor body 130 includes a housing 132 and a circuit board 131 fixedly arranged inside the housing 132. The signal extension cord 120 is electrically connected to the circuit board 131 to transmit the data of the electronic device 200 to the circuit board 131.

The housing 132 has the function of fixing and protecting the circuit board 131. The circuit board 131 is a printed circuit board (PCB), for example, it may be a copper substrate, an aluminum substrate, a ceramic substrate, or the like.

Specifically, a communication module 133 is integrated on the circuit board 131, and the communication module 133 includes an audio processing module and a transmitting and receiving module.

Figure 4:
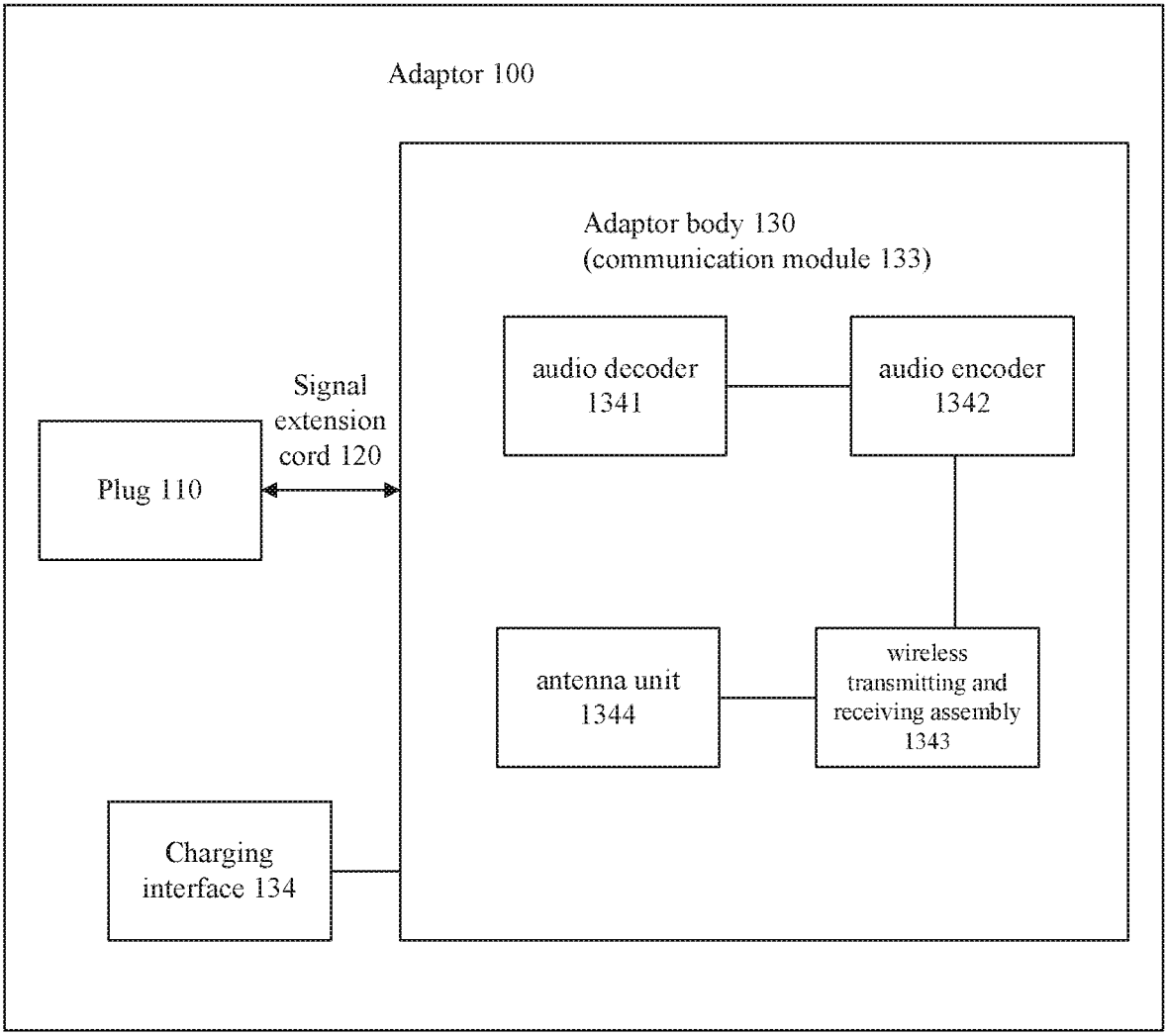
FIG. 4 is a schematic diagram of modules of an adaptor provided by an embodiment of the present application.

As shown in FIG. 4, the audio processing module includes an audio decoder 1341 and an audio encoder 1342, and the transmitting and receiving module includes a wireless transmitting and receiving assembly 1343 and an antenna unit 1344. The audio decoder 1341 obtains the audio information played by the electronic device 200 and decodes it, the decoded audio information then transmits into the audio encoder 1342, and the audio information is encoded into SBC format, ACC format, APTX format or LC3 format etc. through the audio encoder 1342, and then the encoded audio information are transmitted to the wireless transmitting and receiving assembly 1343 to transmit the encoded audio signal through the antenna unit 1344.

The adaptor 100 is in communication connection with the wireless headset. Specifically, a communication connection with the wireless headset is established through the communication module 133, and the adaptor 100 sends an audio signal to the wireless headset, so that the user can listen to the audio of the electronic device 200 through the wireless headset.

The adaptor 100 communicates with wireless headset through 2.4G wireless transmission technology, 5G wireless transmission technology or 5.8G wireless transmission technology, which reduces the delay of transmitting audio and brings a better listening experience to users.

Figure 9:
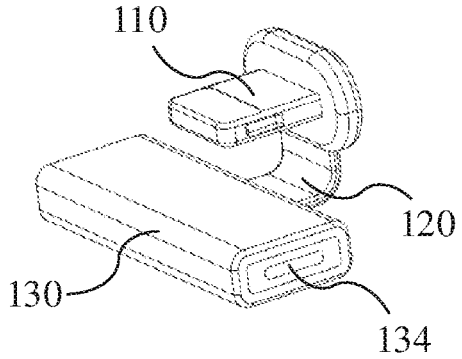
FIG. 9 is a structural schematic view of another adaptor provided by an embodiment of the present application.

Optionally, as shown in FIG. 9, the adaptor body 130 further includes a charging interface 134 provided on the housing 132, the charging interface 134 is electrically connected to the circuit board 131, and when connected to an external power source, it supplies power to the electronic device 200.

When the adaptor 100 is plugged into the electronic device 200, the charging interface of the electronic device 200 is occupied, and the electronic device 200 cannot be charged. The adapter body 130 is provided with the charging interface, such that even if the electronic device 200 is connected to the adaptor 100, it can be charged at the same time without affecting the use of the user. When the power of the electronic device 200 is low, it can be connected to the wireless headset through the adaptor and connected to an external power source, simultaneously. The user does not have to worry about the power issue of the electronic device while enjoying the good sense of hearing brought by the low-latency audio.

Optionally, the electronic device is a mobile phone or a tablet computer. The present application does not limit the type of electronic device 200. As long as the plug 110 of the adaptor 100 matches the communication interface of the electronic device 200, it can be connected to the electronic device 200 to realize the wireless connection between the electronic device 200 and wireless headset or other devices.

Figure 10:
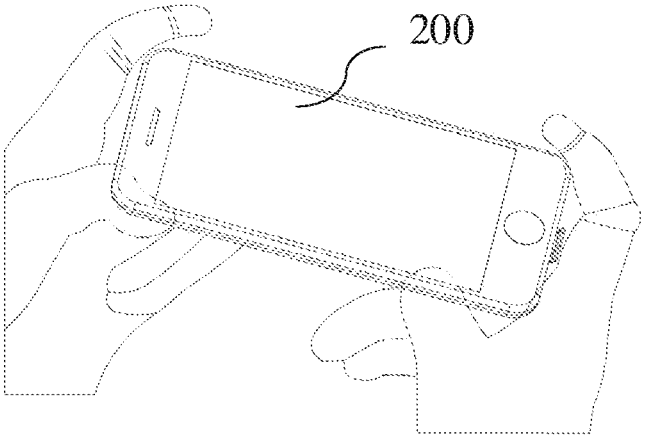
FIG. 10 is a front schematic view of an electronic device when holding horizontally by a user.
Figure 11:
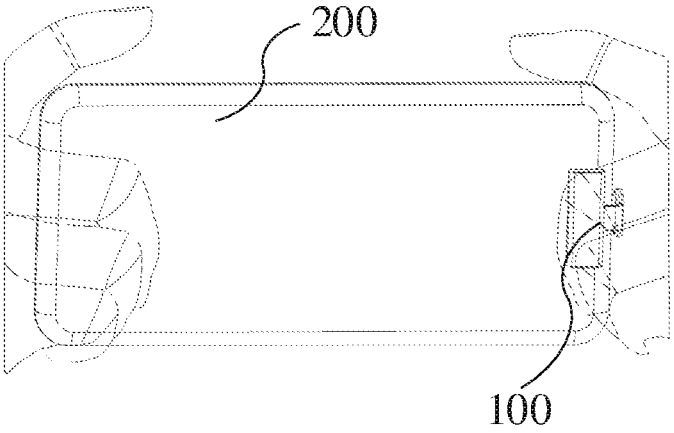
FIG. 11 is a back schematic view of an electronic device when holding horizontally by a user.

FIGS. 10 and 11 are schematic views of the front and back sides of the electronic device horizontally holding by the user when the adaptor 100 is plugged into the electronic device 200, and the mobile phone is taken as an example in the FIGS. It can be seen from the figure that the adaptor 100 does not protrude too much from the bottom edge of the mobile phone. When the user holds the electronic device 200 horizontally, the hand will not be disturbed by the adaptor 100, there will be no situations where it is difficult to hold the mobile phone or touch on the screen. Whether the user is watching a video or playing a game, it will not affect the holding feel of the user.

The above-mentioned embodiments do not constitute a limitation on the protection scope of the technical solution. Any modification, equivalent replacement and improvement made within the spirit and principle of the above-mentioned embodiments shall be included in the protection scope of the technical solution.

What is claimed is:

1. An adaptor, comprising:

a plug;

a signal extension cord; and an adaptor body;

wherein the signal extension cord is in an L shape, and one end of the signal extension cord is connected to a sidewall of a tail end of the plug, the other end of the signal extension cord is connected to the adaptor body, such that the plug, the signal extension cord and the adaptor body are integrally formed a U-shaped structure, and when the adaptor is configured to be plugged into a communication interface of an electronic device, the adaptor body is configured to be located on a back side of the electronic devices; and wherein the signal extension cord comprises: a flexible flat cable and a metal support sheet arranged side by side, and a soft rubber sleeve covering at an outside of the flexible flat cable and the metal support sheet.

2. The adaptor according to claim 1, wherein the plug is a Type-C USB plug, a micro USB plug or a lightning plug.

3. The adaptor according to claim 1, wherein the adaptor is configured to communicate with a wireless headset.

4. The adaptor according to claim 1, wherein the electronic device is a mobile phone or a tablet computer.

5. The adaptor according to claim 1, wherein the L-shaped structure of the signal extension cord is a fixed curved structure.

6. The adaptor according to claim 5, wherein the adaptor body comprises: a housing, a circuit board and a communication module, the circuit board and the communication module are fixedly disposed inside the housing, and the communication module is fixedly arranged on the circuit board, the signal extension cord is electrically connected to the circuit board.

7. The adaptor according to claim 1, wherein the adaptor body comprises: a housing, a circuit board and a communication module, the circuit board and the communication module are fixedly disposed inside the housing, and the communication module is fixedly arranged on the circuit board, the signal extension cord is electrically connected to the circuit board.

8. The adaptor according to claim 7, wherein the adaptor body further comprises: a charging interface electrically connected to the circuit board, and the charging interface is configured for charging the electronic device.

9. The adaptor according to claim 1, wherein the L-shaped structure of the signal extension cord is an adjustable curved structure.

10. The adaptor according to claim 9, wherein the adaptor body has a flat structure and is configured for closely attaching to the back side of the electronic device.

11. The adaptor according to claim 9, wherein the adaptor body comprises: a housing, a circuit board and a communication module, the circuit board and the communication module are fixedly disposed inside the housing, and the communication module is fixedly arranged on the circuit board, the signal extension cord is electrically connected to the circuit board.

12. The adaptor according to claim 6, wherein the adaptor body further comprises: a charging interface electrically connected to the circuit board, and the charging interface is configured for charging the electronic device.

13. The adaptor according to claim 11, wherein the adaptor body further comprises: a charging interface electrically connected to the circuit board, and the charging interface is configured for charging the electronic device.

* * * * *